United States Patent [19]

Harner et al.

[11] 4,455,058

[45] Jun. 19, 1984

[54] ELECTRICAL CONNECTOR FOR FLAT CABLE

[75] Inventors: Donald R. Harner, Camp Hill; Robert C. Kaley, Landisville; Christopher L. Crawford, Harrisburg, all of Pa.

[73] Assignee: AMP Incorporated, Harrisburg, Pa.

[21] Appl. No.: 364,152

[22] Filed: Mar. 31, 1982

[51] Int. Cl.[3] ..... H01R 4/24

[52] U.S. Cl. ..... 339/99 R; 339/17 F; 339/91 R

[58] Field of Search ..... 339/75 MP, 97 R, 97 P, 339/99 R, 98, 17 F, 176 MF, 176 MP, 91 R; 220/338, 306; 24/201 HE, 225, 236, 237; 292/19, 80, 87

[56] References Cited

U.S. PATENT DOCUMENTS

| | | | |
|---|---|---|---|
| 4,010,998 | 3/1977 | Tolnar, Jr. et al. | 339/91 R |
| 4,192,568 | 3/1980 | Marks et al. | 339/91 R |
| 4,293,177 | 10/1981 | Weisenburger | 339/99 R |
| 4,341,430 | 7/1982 | Crawford | 339/99 R |

*Primary Examiner*—John McQuade
*Attorney, Agent, or Firm*—Robert W. J. Usher

[57] ABSTRACT

An electrical connector housing for flat cable comprising first and second members movable between mutually adjacent and remote positions corresponding to closed and open conditions of the housing respectively. Latching means comprise a latch bar and a release bar supported for deflection adjacent an end of one member and extending spaced apart in side-by-side relation interconnected by a plurality of transverse struts to defining an eye. A catch means on the other member is receivable in the eye in latching engagement with the latching bar in the closed condition of the connector housing, movement of the release bar in the direction of the latch bar deflecting the latch bar, thereby to disengage the catch means from the latch bar. The latch bar and release bar are resiliently flexible and the latch bar is joined at respective opposite ends of a slot to the one member by relatively rigid webs, deflection of the release bar towards the one member flexing the latch bar to disengage the catch member from the latch bar. The latch bar carries catch portions, the catch portions adjacent lateral ends of the bar being located rearwardly, in the direction of deflection, of catch portions adjacent central portions of the bar.

4 Claims, 6 Drawing Figures

11
19
10
12
14
15
18
19
21
13
31
24
43
30
38
22
41
40
43
34
25
42
37
35
45
46
38

ELECTRICAL CONNECTOR FOR FLAT CABLE

The invention relates to electrical connector housings and, in particular to an electrical connector housing for flat cable.

In view of the increasing miniaturization of electrical packages and components, particularly for printed circuit board applications, there is a requirement for electrical connector housings which are of small size but which can be reliably latched in closed condition and readily opened. At the same time, it is important that such latches are not easily released inadvertently. In addition, such housings should have a minimal number of components each of which should be adapted for moulding in plastics material and which can readily be assembled together to facilitate mass production at low cost.

According to one aspect of the invention, there is provided an electrical connector housing comprising first and second members movable between mutually adjacent and remote positions corresponding to closed and open conditions of the housing respectively, latching means comprising a latch bar and a release bar supported for deflection adjacent an end of one member and extending spaced apart in side-by-side relation interconnected by a plurality of transverse struts to define an eye, and catch means on the other member receivable in the eye in latching engagement with the latch bar in the closed condition, movement of the release bar in the direction of the latch bar deflecting the latch bar, thereby to disengage the catch means from the release bar.

A particular application of the invention is in an electrical connector housing for terminating flat cable without a requirement for stripping insulation from individual conductors prior to termination.

Such electrical connector comprises a base member, a cable locating member pivotally connected to the base member and having a flat cable receiving pocket, a series of electrical terminals mounted on the base member having conductor engaging portions projecting towards the pocket so that, with the connector in an open condition in which the cable locating member is remote from the base member, flat cable can be located in the pocket and subsequent pivotal movement of the locating member towards the base member to place the connector in a closed condition will drive the conductor engaging portions into the cable to establish electrical connections with respective conductors of the cable, the base member and the locating member being provided with interengageable latching means comprising a latch bar and a release bar extending spaced apart in side-by-side relation and supported for deflection adjacent an end of one member and interconnected by a plurality of transverse struts defining an eye, and catch means on the other member, receivable in the eye in latching engagement with the latching bar in the closed condition, movement of the release bar in the direction of the latch bar deflecting the release bar thereby to disengage the latch from the release bar.

Preferably, the latch bar is spaced from the one member by an elongate slot extending for a majority of the length of the latch bar.

The provision of the slot enables the latch bar to be formed conveniently during moulding the member.

Desirably, the latch bar and release bar are resiliently flexible and the latch bar is joined at respective opposite ends of the slot to the one member by relatively rigid webs, deflection of the release bar towards the one member flexing the latch bar to disengage the catch member from the latch bar.

The provision of the rigid webs prevents inadvertent pressure on the bar in directions other than a release direction from breaking the latch bar away from the member.

More specifically, the struts define with the latch bar and the release bar a series of eyes and the latch bar has catch portions adjacent reflective eyes, the catch portions adjacent lateral ends of the bar being located rearwardly. in the direction of deflection, of catche portions adjacent central portions of the bar.

Depression of the release bar in the release direction causes bowing of the latch bar into the slot which bowing is accommodated by the rearward staggering of the catch portions thus, although the central portion of the latch bar is deflected more than lateral portions, secure latching is assured.

A particular example of the invention will now be described with reference to the accompanying drawings in which.

Figure 1:
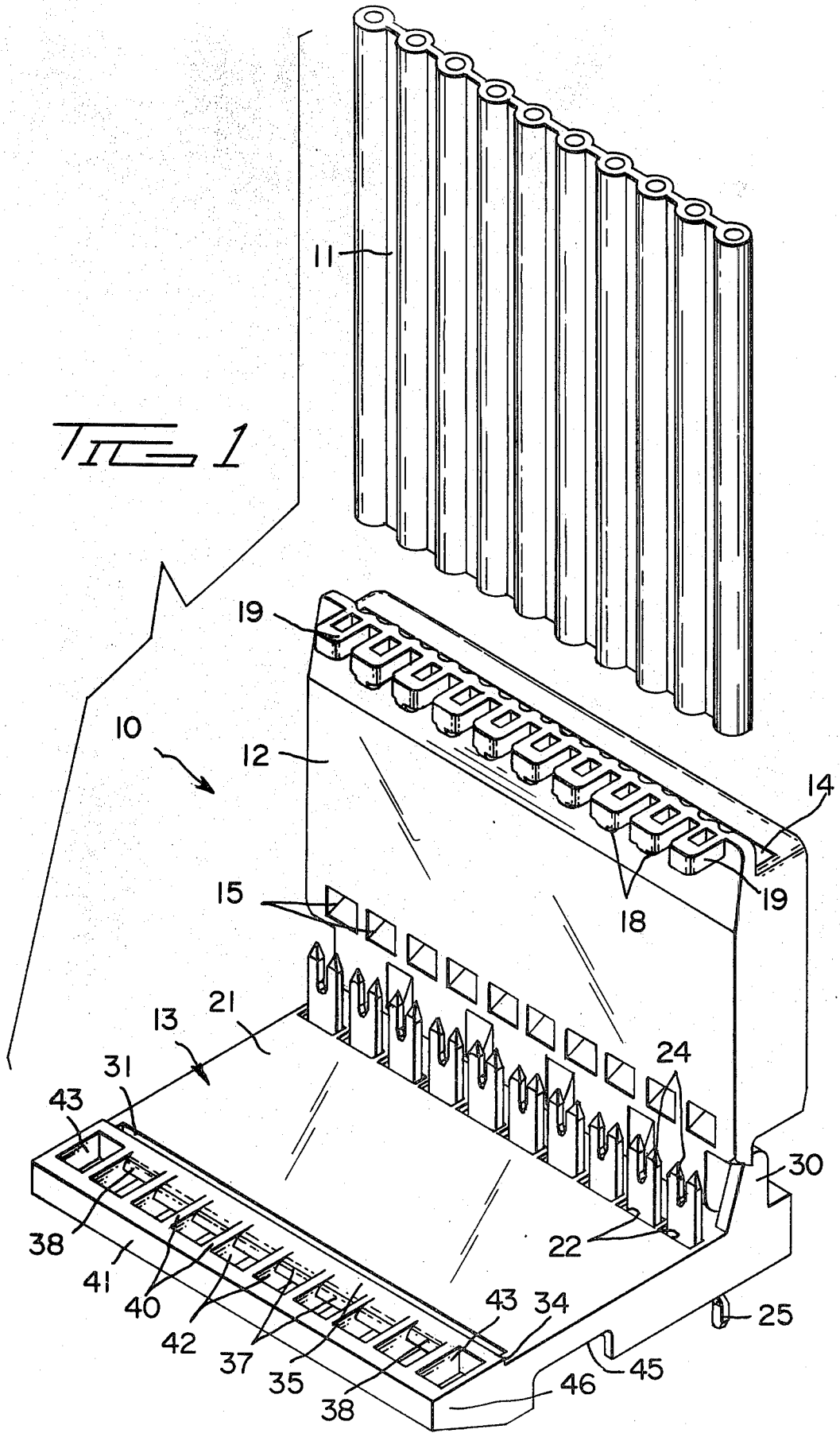
FIG. 1 is a perspective view of the connector in an open condition with a holder for ribbon cable remote from a base.
Figure 2:
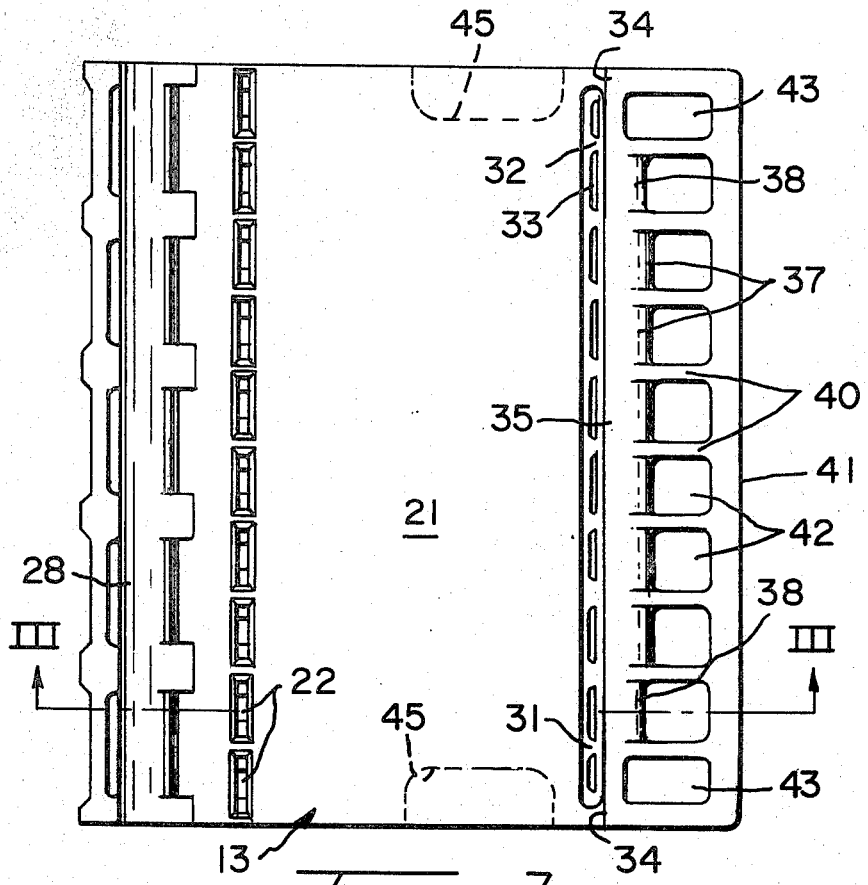
FIG. 2 is a plan view of a connector base with terminals omitted.
Figure 3:
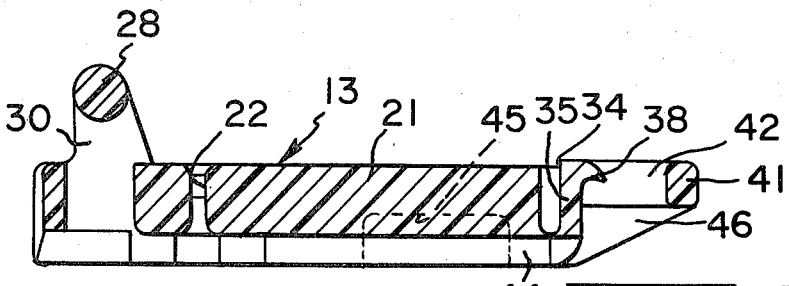
FIG. 3 is a cross-sectional view of the base with terminals omitted taken along line III-III of FIG. 2.

As shown particularly in FIGS. 1 to 4, electrical connector 10 for terminating ribbon cable 11 comprises a cable holder 12 and a base 13 each molded in one piece from suitable plastics material and pivotally connected together along a rear end.

The cable holder 12 is formed with a blind-ended pocket 14 having a cable receiving mount at a front end and intersected by a series of slots 15 adjacent the blind end. A row of hooks 16 extend along the one end. A row of apertured lugs 17 depend from a central part of the front edge of the holder and carry at free ends respective catches 18. An apertured guiding lug 19 depends from the front edge of the holder adjacent respective opposite ends of the row of lugs 17.

The base 13 comprises a central platform 21 rearwardly of which are formed sockets 22 receiving terminals 23 having bifurcated conductor engaging portions 24 at upper ends and legs 25 at lower ends for receipt in apertures in a printed circuit board 26. A hinge pin 28 extends along the rear end supported at intervals along its length by flanges 30 and in pivotal engagement with the hooks 16.

A slot 31 extends downwardly into the platform adjacent the front end for substantially the entire depth of the platform so that only a thin web 32 remains at the slot base, the web being perforated at intervals by apertures 33. The slot defines a resiliently flexible latch bar 35 extending along the front end and integrally joined at respective opposite ends by webs 34 of the platform 21. The latch bar 35 is connected at intervals by transverse bridges or struts 40 to a resiliently flexible release bar 41 extending in parallel relation with the latch bar 35. The struts 40 define between them, eyes 42 and 43 aligned with the respective lugs 17 and 19 depending from the holder 12 and from catches 37 and 38 extend from the front edge of the latch bar 35 into each eye 42. It should be noted that the most lateral catches 38 are located rearwardly of the central catches 37.

A series of elongate feet 44 extend from the front to the rear of platform 21 located in spaced apart parallel relation.

Tool receiving recesses 45 are provided adjacent lateral edges of the base.

In operation of the connector 10 to terminate a ribbon cable 11, the connector 10 is mounted on a printed circuit board and the cable end inserted into the pocket 14 with the holder 12 remote from the base 13. A simple tool is then used to urge the holder 12 towards the base 13 during which movement the conductor engaging portions 24 of the terminals 23 through the slots 15 and into engagement with the conductors of the ribbon cable. During the final stages of movement, the catches 18 on the holder and the catches 37 and 38 on the base interengage with a snap action securely to latch the holder and the base together.

Release of the holder from the base is achieved by depressing the release bar 41 in the plane of the base in a rearward direction. The release force is transmitted from the release bar to the latch bar 35 by the struts 40 causing the latch bar to bow rearwardly into the slot 31 withdrawing the catches 37 and 38 from catches 18. The above mentioned staggering of the catches permits ready release although the linear displacement of the lateral portions of the release bar is less than that of the central portion as a result of the presence of strengthening webs 34. As the staggering of the catches accommodates the non-linear displacement of the latching bar, the catches 37 can be located sufficiently far forward to provide optimum latching security.

It should also be noted that the catches can only be released by depression of the release bar rearwardly of the base and not by a force applied to the bar perpendicularly to the base ensuring that release is only obtained by a deliberate action and avoiding inadvertent release possibly otherwise caused by mounting or removing of other components from a printed circuit board.

The provision of the strengthening webs 34 at respective opposite lateral ends of the slot ensure that the latch and release bars cannot be broken away from the platform 21 by an inadvertent force applied perpendicularly to the platform. Additional strength is added by the gussets 46 at respective opposite lateral sides of the front end of the base.

Further security may be obtained by the presence of the terminated cable overlying the release bar.

The connector latching mechanism occupies very little space which is an important factor when using printed circuit boards in view of the requirement for miniaturization in modern electrical equipment.

Figure 5:
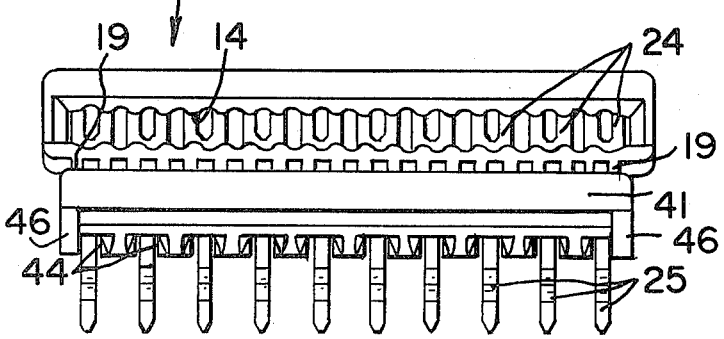
FIG. 5 is a front elevation of the connector.
Figure 4:
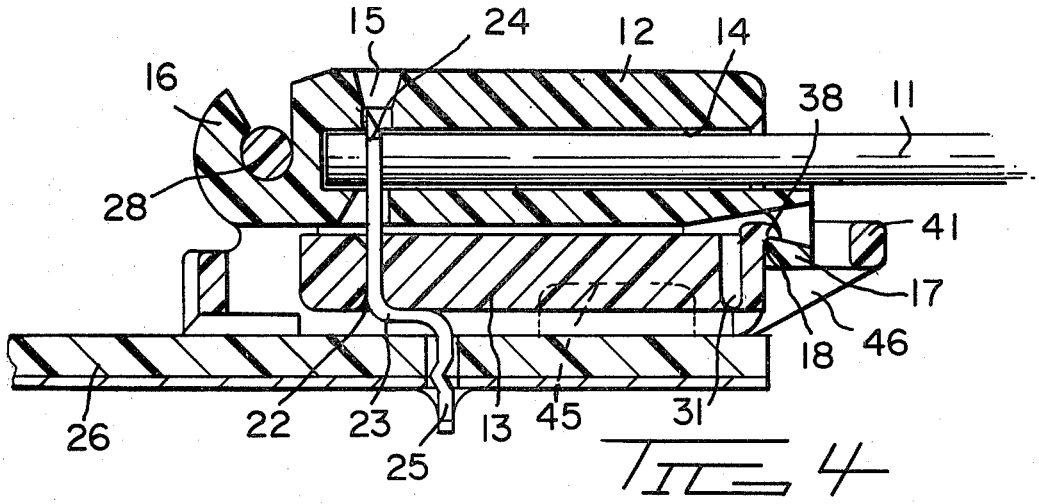
FIG. 4 is a cross-sectional view of the connector in a closed condition terminating a ribbon cable.
Figure 6:
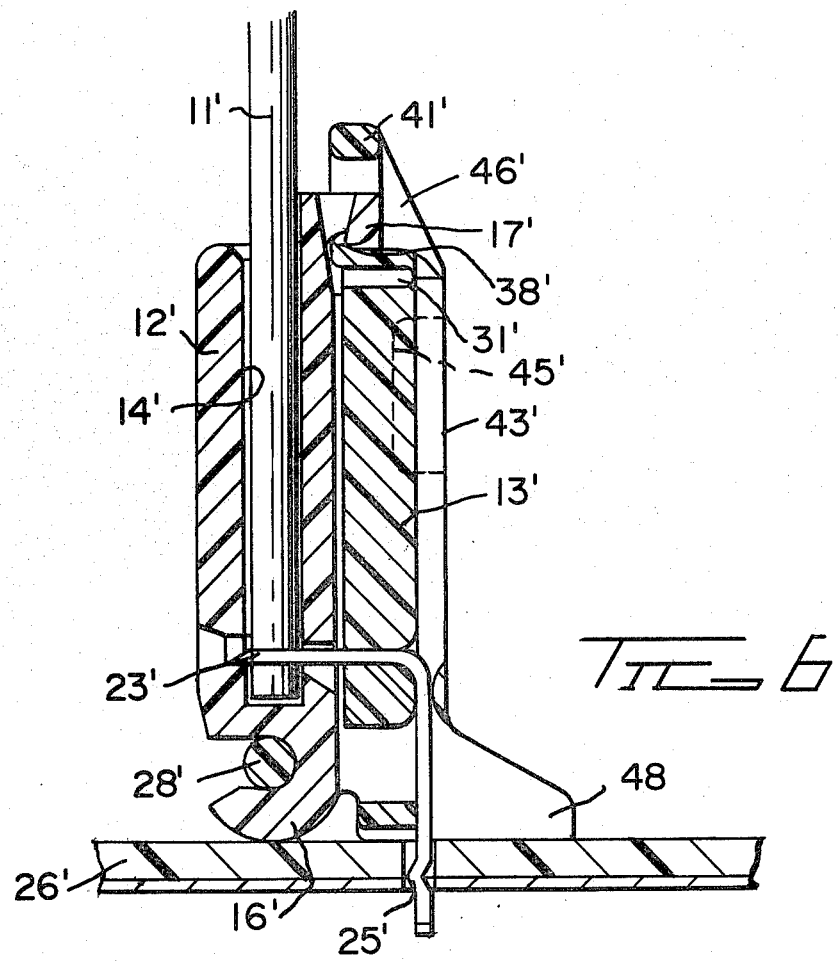
FIG. 6 is a cross-sectional view of a modified connector in a closed condition terminating a ribbon cable.

The modified connector shown in FIG. 5 is closely similar to the connector of FIGS. 1 to 4 and similar parts are indicated by primed reference numerals. However, the base is adapted to upstand from the printed circuit board by the provision of feet 48 extending transversely from opposite lateral edges of the base.

We claim:

1. A two-piece electrical connector housing for terminating flat cable comprising a base member and a cable locating member pivotally connected to the base member and having a cable-receiving pocket, a series of electrical terminals mounted on the base member adjacent the pivotal connection and having insulation penetrating, conductor engaging portions projecting towards the pocket so that, with the connector in an open condition, in which the cable locating member is remote from the base member, flat cable can be located in the pocket and subsequent pivotal movement of the locating member towards the base member to place the connector in a closed condition will drive the conductor engaging portions into the cable to establish electrical connections with respective conductors of the cable, the base member and the locating member being provided with interengageable latching means comprising a resiliently flexible latch bar and a resiliently flexible release bar extending spaced apart in side-by-side relation and supported for deflection adjacent an end of one member and interconnected by a plurality of transverse struts defining an eye, and catch means on the other member receivable in the eye in latching engagement with the latching bar in the closed condition, the latch bar being spaced from the one member by an elongate slot extending for a majority of the length of the latch bar and joined at respective opposite ends of the slot to the one member by relatively rigid webs, movement of the release bar towards the latch bar flexing the latch bar towards the one member thereby to disengage the catch means from the latch bar.

2. An electrical connector according to claim 1 in which the struts define with the latch bar and the release bar a series of eyes and the latch bar has catch portions adjacent respective eyes, the catch portions adjacent lateral ends of the bar being located rearwardly, in the direction of deflection, of catch portions adjacent central portions of the latch bar.

3. An electrical connector housing comprising first and second members movable between mutually adjacent and remote positions corresponding to closed and open conditions of the housing respectively, latching means comprising a latch bar and a release bar supported for deflection adjacent an end of one member and extending spaced apart in side-by-side relation interconnected by a plurality of transverse struts to define an eye, and catch means on the other member receivable in the eye in latching engagement with the latch bar in the closed condition the latch bar being spaced from the one member by an elongate slot extending for a majority of the length of the latch bar and joined at respective opposite ends of the slot to the one member by relatively rigid webs, movement of the release bar in the direction of the latch bar flexing the latch bar, thereby to disengage the catch means from the latch bar.

4. An electrical connector according to claim 3 in which the struts define with the latch bar and the release bar a series of eyes and the latch bar has catch portions adjacent respective eyes, the catch portions adjacent lateral ends of the bar being located rearwardly, in the direction of deflection, of catch portions adjacent central portions of the latch bar.

* * * * *